United States Patent [19]

Suck et al.

[11] Patent Number: 4,915,262

[45] Date of Patent: Apr. 10, 1990

[54] HEAD FOR DISPENSING REGULATED AMOUNTS OF MATERIAL FOR USE WITH A PRESSURIZED CONTAINER WITH A CONTINUOUS VALVE

[75] Inventors: Catherine Suck, Sceaux; Pierre Bret, Vetraz-Monthoux; Jacques Pozzi, Meudon, all of France

[73] Assignee: Societe de Promotion Recherche et Innovation Technologique, Sceaux, France

[21] Appl. No.: 182,351

[22] Filed: Mar. 23, 1988

[30] Foreign Application Priority Data

Mar. 25, 1987 [FR] France ..... 87 4180

[51] Int. Cl.[4] ..... B65D 37/00

[52] U.S. Cl. ..... 222/207; 222/402.2; 137/625.68

[58] Field of Search ..... 222/402.2, 207, 214, 222/400.5, 402.13, 402.25, 402.1; 137/825.68

[56] References Cited

U.S. PATENT DOCUMENTS

| | | | |
|---|---|---|---|
| 2,989,217 | 6/1961 | Focht | 222/402.2 |
| 3,250,444 | 5/1966 | Ward | 222/402.2 |
| 3,269,615 | 2/1966 | Ferry, Jr. | 222/402.2 |
| 3,278,093 | 10/1966 | Lehmann | 222/402.2 |
| 3,858,771 | 1/1975 | Bret et al. | 222/402.2 |
| 4,809,888 | 3/1989 | Suck et al. | 222/402.2 |

*Primary Examiner*—Kevin P. Shaver
*Assistant Examiner*—Kenneth Noland
*Attorney, Agent, or Firm*—Darby & Darby

[57] ABSTRACT

The axial passage (15) of the central foot (14) of the membrane support (13) comprises a valve seat (14) applied on the extremity of a hollow stem (5) of the continuous valve to fill the measuring cap (11) during the phase of measuring the amount of material to be dispensed, and which moves away from the extremity of the hollow stem (5) to put in communication the measuring cap and the port (21) during the discharge phase.

7 Claims, 3 Drawing Sheets

Figure 1:
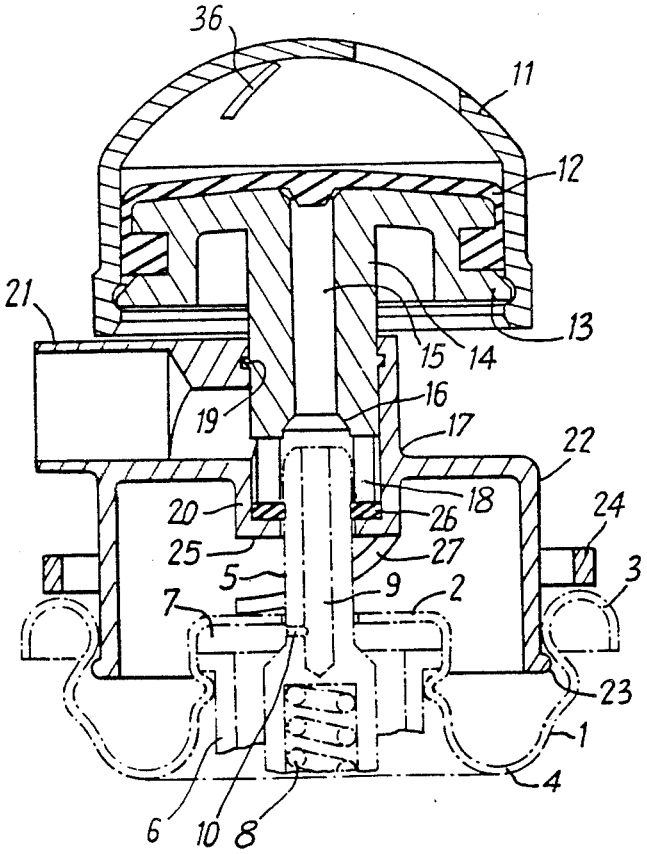

HEAD FOR DISPENSING REGULATED AMOUNTS OF MATERIAL FOR USE WITH A PRESSURIZED CONTAINER WITH A CONTINUOUS VALVE

The present invention relates to a head for dispensing regulated amounts of material, for use with a pressurized container with a continuous valve.

It is known in the art to provide on a continuous valve with a hollow stem, a measuring cap to form a valve unit for dispensing requlated amounts of material. For example, the document No. FR-A-1 325 336 describes a rubber measuring cap in which an element is provided on the hollow stem of the continuous valve.

This element comprises a passage to put in communication the hollow stem of the continuous valve with a measuring chamber which, in turn, communicates through another passage with the discharge nozzle. In this other passage is provided a check valve which may be closed by applying finger pressure on the valve head, and opened by release of the pressure. Since all of the elements of the measuring cap are made of rubber, in other words deformable in all directions, it is difficult to obtain a steady measuring action of the amounts of material to be dispensed, as well as a good efficiency of the check valve. Plus, the manufacture of the check valve and of the measuring chamber with a movable wall, is complex.

An object of the invention is a head for dispensing regulated. amounts of material which may be mounted easily on a pressurized container with a continuous valve and that may be removed therefrom.

Another object of the invention is to provide a dispensing head which is of a simple and inexpensive construction.

The subject of the invention is a head for dispensing regulated amounts of material, for a pressurized container with a continuous valve, in which container is provided a plug comprising a centrally located platform with an axial opening for the continuous valve, of a type comprising a measuring cap with a resilient diaphragm and a diaphragm support with a central foot through which extends an axial passage, and a coupling, characterized in that the axial passage of the central foot of the diaphragm support comprises a valve seat which is applied directly or indirectly on the continuous valve for filling the measuring cap during the phase of measuring the amount of material to be dispensed, and which moves away after the continuous valve to put in communication the measuring cap and the discharge port during the discharge phase.

According to other features of the invention:

(a) around the hollow stem is provided a seal or lip which slides on the hollow stem in sealing engagement therewith;

(b) the seal is mounted on the bottom of a central chamber of the coupling;

(c) the bottom of the central chamber carries two arcuate elements whose free ends rest on the central platform of the plug, acting as springs to urge the dispensing head toward its discharge position;

(d) in the case of a continuous valve of the female type, the dispensing head is provided with a coupling element in the form of a hollow stem and carrying a supporting disk for the arcuate elements;

(e) the measuring cap is integrally formed with the coupling;

(f) the coupling comprises a disk with an axial passage and, around the axial passage is provided a truncated cone for cooperating with the valve seat of the central foot of the diaphragm support;

(g) the disk has on its lower portion a cylindrical sleeve cooperating with the continuous valve of the pressurized container;

(h) the cylindrical sleeve is mounted in sealing engagement on the hollow stem of a continuous valve of the male tape;

(i) the cylindrical sleeve is supported on the body of a continuous valve of the female type;

(j) the coupling comprises a central cylindrical chamber which extends upwardly around the central foot, and carries an outwardly extending annular rib adapted to engage through a snap fit in a locking manner an annular rib on a cylindrical skirt of the membrane support; and (k) the central foot is provided with a seal or a lip supported by a shoulder.

Figure 2:
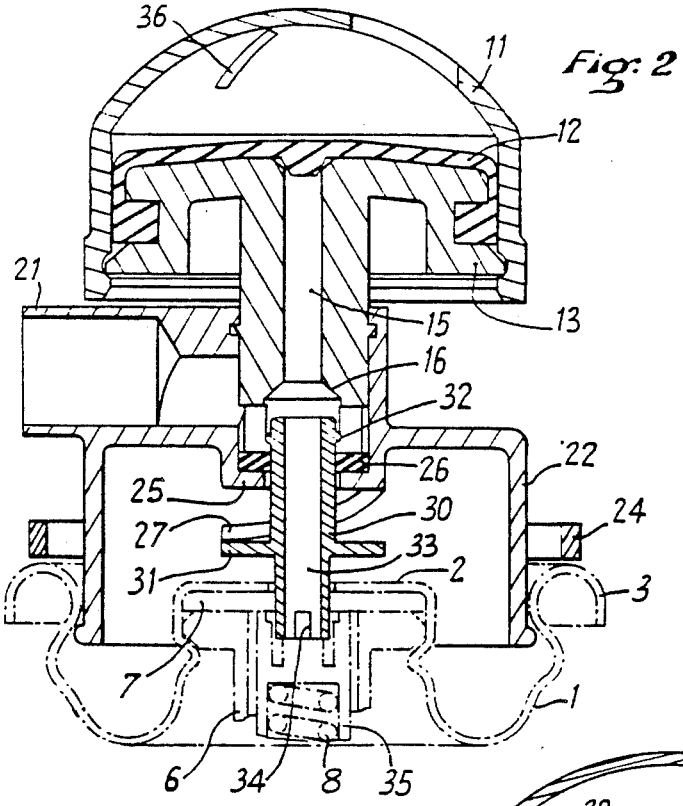

Other characteristics of the invention will become apparent as the following description proceeds which is made with reference to the annexed drawings in which:

FIG. 1: an axial sectional view of a first embodiment of a dispensing head for a pressurized container with a hollow stem continuous valve;

FIG. 2: a view similar to FIG. 1 of a second embodiment of the invention adapted for a female type valve.

Figure 3:
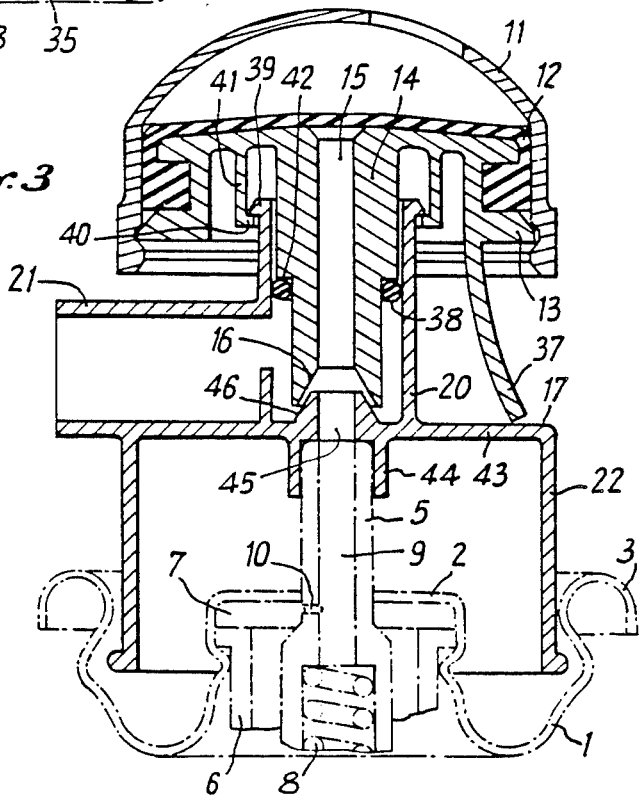
Figure 4:
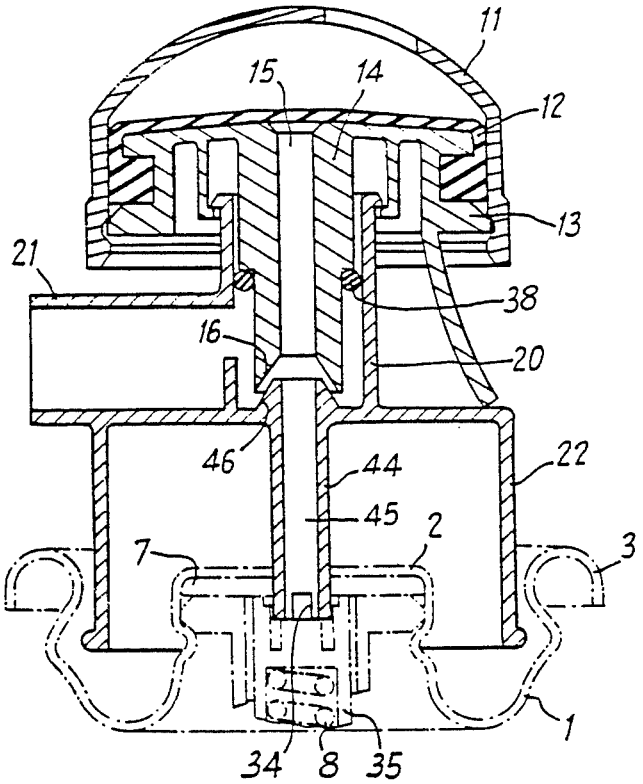
Figure 5:
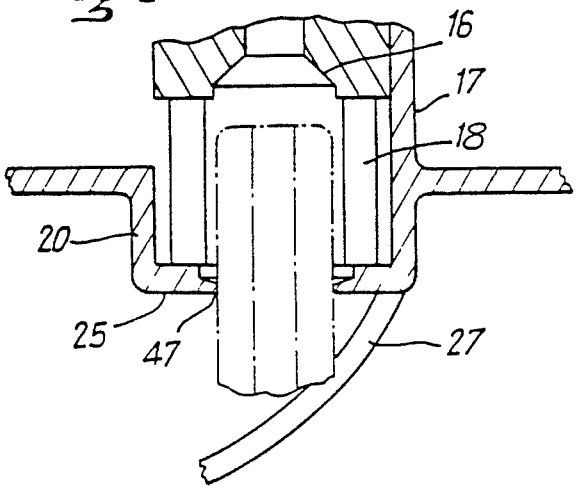

FIG. 3: a view similar to FIG. 1 of a third embodiment of the invention adapted for a hollow stem continuous valve;

FIG. 4: a view similar to FIG. 3 of a fourth embodiment of the invention adapted for a continuous valve of the female type; and FIG. 5: a detailed view illustrating a variant of the seal on the hollow stem of the continuous valve of FIG. 1.

FIG. 1 illustrates a plug 1 which constitutes the upper part of a pressurized container which is not shown in the drawings. This plug comprises a central platform 2, an annular collar 3 and, between the platform 2 and the annular collar 3, an annular groove 4. The central platform 2 is provided with an axial opening through which extends the hollow stem 5 of the continuous valve mounted in the container. A seal 7 is mounted between the central platform 2 and the body 6 of the continuous valve. The stem 5 is urged outwardly of the container by a spring 8. The stem 8 comprises an axial passage 9 closed at one end and having an upper open end, and a radial opening 10 leading to the axial passage 9. When the continuous valve is in a closed position, as shown in FIG. 1, the opening 10 is closed by the seal 7. If one presses on the stem 5, to compress the spring 8, the opening 10 moves below the seal 7 and pressurized liquid in the container 10 can escape through the opening 10 and the axial passage 9.

All the elements in the above description are known in the art and have been shown in dotted lines in FIG. 1. The dispensing head, according to the invention, is adapted to be mounted on the stem 5. This dispensing head comprises the following elements: a measuring cap 11 defining a selected volume of liquid to be dispensed; a diaphragm 12 made of rubber or elastomeric material, acting as a resilient wall of a measuring chamber; a membrane support 13; and a coupling 17. The membrane support 13 is mounted, in a locking manner through a snap fit for example, in the measuring cap 11; it comprises a central foot 14 with an axial passage 15 defining at its base a valve seat 16. Past the valve seat 16, the central foot 14 displays fingers 18. At last, the central foot 14 carries at its periphery an annular rib 19, triangular in cross section for example, on which is engaged the coupling 17 in a locking manner by a snap fit. The coupling 17 comprises: a central cylindrical chamber 20 encircling the central foot 14 of the diaphragm support 13; a radially extending port 21; and a cylindrical sheath or skirt 22 which is of a length sufficient so that its free edge slides under the annular collar 3 to keep the dispensing head on the container. At this end, the free edge of the skirt 22 has an outer rib 23. The skirt 22 further comprises, on the outside, a rupturable tab 24 which acts as a stop on the annular collar 3 to prevent the dispensing head to be depressed. When the safety tab is removed, the dispensing head may be operated.

The central chamber 20 comprises an annular bottom 25 through which extends the stem 5. In the chamber 20, resting on the bottom 25, is mounted a seal 26 on which abut the fingers 18. Thus, the seal 26 slides on the valve stem 5 in a sealing engagement therewith. At last, the bottom 25 of the chamber 20 carries on the outside two arcuate elements 27 whose free ends rest on the central platform 2 of the plug 1 and which act as springs and cooperate during the upward movement of the dispensing head when the finger pressure thereon is released.

The operation of the dispensing head according to the invention is as follows. Initially, the dispensing head is mounted on the container provided with its continuous valve with a hollow stem 5. The installation is carried out by exerting a slight pressure on the coupling 17 so that the outer rib 23 which edges the skirt 22 passes beyond the annular collar 3. The downward correlative movement of the dispensing head is interrupted by the safety tab 24 which abuts on the annular collar 3. During the installation of the dispensing head, the seal 26 slides on the hollow stem 5, as shown in FIG. 1.

Before operating the dispensing head, the rupturable tab 24 must be removed. Then, if one presses on the cap 11, the valve seat 16 presses on the extremity of the stem 5, then lowers the stem by compressing the spring 8 until the radially extending opening 10 moves below the seal 7. The pressurized liquid in the container flows through the radial opening 10, the axial passage 9 of the stem 5, and through the axial passage 15 of the central foot 14 of the diaphragm support 13, and pushes the resilient diaphragm 12 against the cap 11. For an accurate measurement of the amount of material to be dispensed, the cap 11 is provided with vents 36.

The valve seat 16 applied on the stem 5 prevents the pressurized liquid to flow towards the port 21.

When finger pressure on the cap 11 is released, the spring 8 raises the stem 5 until the radial opening 10 is closed by the seal 7, thus closing the container. The arcuate elements 27 contribute to raise the dispensing head, until the rib 23 abuts on the annular collar 3. From the moment the stem 5 has terminated its upward movement, the valve seat 16 extends away from the extremity of the stem 5, opening the passage toward the port 21. Then, the pressurized liquid in the cap 11 can escape, by expanding, through the port 21. The resilient diaphragm 12 assumes its initial position and contributes to eject the liquid.

The product in the container is in liquid form and it is under pressure. During the phase of measuring the amount of product to be dispensed, in other words during the filling of the measuring cap, it remains under pressure and in liquid form. However, during the discharge phase, the product is at atmospheric pressure and it can be dispensed in a form other than a liquid. Thus, one may dispense a spray, a foam or a cream for example. In the case of a foaming product, a volume of liquid is measured and a foam is dispensed whose volume or quantity is proportional to the volume of the cap.

On FIG. 2 is shown a plug 1 identical to the one shown in FIG. 1, but mounted on a container provided with a continuous valve of the female type, in other words a valve which does not have a hollow stem 5 as the one shown in FIG. 1. To enable the dispensing head, according to the invention, to be used with this type of valve, it suffices to provide a coupling element 30 as the one shown in FIG. 2. The coupling element 30 has the shape of a hollow stem whose head is received in the cylindrical chamber 20 and comprises a peripheral rib 32 to hold the head above the seal 26. The coupling element 30 comprises a disk 31 supporting the arcuate elements 27. The coupling element 30 is provided with an axial passage 33 which extends completely therethrough and it has at its lower end at least one notch 34.

When the cap 11 is depressed, the valve seat 16 is applied on the extremity of the coupling element 30, thus pushing back the coupling element which compresses the spring 8 and pushes back the piston 35 of the valve by separating it from the seal 7. Then, pressurized liquid passes through the notches 34 of the coupling element 30, through its axial passage 33, through the axial passage 15 of the diaphragm support 13 and raises the diaphragm 12 to fill the cap 11. When the finger pressure is released, the spring 8 pushes back the piston 35 and the coupling element 30 closes the container, then the arcuate elements 27 push the dispensing head with respect to the coupling element 30, which has the effect of separating the valve seat 16 from the extremity of the coupling element 30 to enable the product to be discharged.

According to the third embodiment of the invention, shown in FIG. 3, the coupling 17 is not unitary with the central foot 14 of the diaphragm support 13. In this case, the fingers 18 and the annular rib 19 have been omitted, to allow a relative movement of the central foot 14 with respect to the coupling 17. In a similar way, the arcuate elements 27 have been omitted and to ensure that the measuring cap is sent back up, at least one arcuate element 37 is mounted under the diaphragm support 13, resting on the coupling 17.

The cylindrical chamber 20 extends upwardly and comprises an outer annular rib 39, adapted to engage through a snap fit in a locking manner an annular rib 40 extending inwardly and carried by a cylindrical skirt 41, in turn carried by the diaphragm support 13. The central foot 14 comprises an annular shoulder 42 to support a seal 38 to provide sealing between the central foot 14 and the cylindrical chamber 20.

The skirt 22 of the coupling 17 extends above the hollow stem 5 of the continuous valve. The coupling 17 comprises a disk 43 which rests on the hollow stem 5. The disk 43 carries a cylindrical sleeve 44 extending downwardly and being fitted on the hollow stem 5 to provide a sealing engagement between the hollow stem 5 and the coupling 17. The central part of the disk 43 is provided with a central passage 45 which corresponds to the passage 9 of the hollow stem 5. Around the passage 45 is provided a truncated cone 46 adapted to cooperate with the valve seat 16 of the central foot 14. In this way, the valve seat 16 is applied indirectly on the continuous valve and the operation of the dispensing head defers only by the relative motion of the measuring cap 11 and of the coupling 17, on one hand until the valve seat 16 is applied on the truncated cone 46 before measuring the amount of material to be dispensed, and on the other hand when it moves away from the measurement and during the expulsion.

On FIG. 4, one may gather that the dispensing head on FIG. 3 has been adapted for a continuous valve of the female type, as the one shown in FIG. 2. The cylindrical sleeve 44 has been extended downwardly to contact the valve body 35. It comprises at the base thereof at least one notch 34. The operation is the same as for the device of FIG. 3.

On FIG. 5 is shown a variant of the embodiment to provide sealing on the hollow stem shown in FIG. 1. In this embodiment, the seal 26 has been omitted. The fingers 18 extend to the bottom 25 of the cylindrical chamber 20. Around the hollow stem 5, the bottom 25 carries an annular lip 47 resulting from a moulding operation, which rides on the hollow stem 5 in a sealing engagement therewith.

In a similar manner, the seal 38 provided on the central foot 14, in the case of FIGS. 3 and 4, may be replaced by a lip resulting from a moulding operation and carried by the upper edge of the shoulder 42, and similar to the lip 47 shown in FIG. 5.

The dispensing head according to the invention has numerous advantages, among others:

a relatively small number of constituant elements, permitting an automated manufacturing;

except for the seals 26, 38 and the diaphragm 12, the other constituant elements are of molded plastic material;

the immediate adaptability to continuous valves of the male and female type.

We claim:

1. A dispensing head for a pressurized container using a continuous valve, comprising a plug adapted for sealing engagement with the pressurized container, said plug having a central platform with an opening going therethrough for receiving said continuous valve;

a measuring cap having a resilient diaphragm supported by a diaphragm support, said diaphragm support having a central foot, an axial passage passing through said central foot, a connecting sleeve having a first engaging rib extending from said diaphragm support, a coupling connecting said diaphragm support with said plug, said coupling having a dispensing port in a central chamber extending in the direction of the diaphragm support, said central chamber having a second engaging rib, whereby in an assembled condition of the dispensing head said first engaging rib of the connecting sleeve engages said second engaging rib of the central chamber in a locking manner to keep the assembly together, said coupling having a disk defined by at least inner and outer surfaces, an axial passage passing through the disk, an engaging member extending outwardly from said outer surface and surrounding said axial passage, said receiving element of the central foot being adopted to receive said engaging member; and a supporting member extending from the inner surface and surrounding said axial passage, said supporting member being adopted for cooperation with the continuous valve of the pressurized container.

2. A dispensing head according to claim 1, wherein the supporting member is a cylindrical sleeve sealingly mounted on the hollow stem of a male type continuous valve.

3. A dispensing head according to claim 2, wherein the cylindrical sleeve rests on a body (35) of a female type continuous valve.

4. A dispensing head according to claim 1, wherein the central foot is provided with a seal or a sealing lip, held or carried by a shoulder.

5. A dispensing head for a pressurized container using a continuous valve, comprising a plug adapted for sealing engagement with the pressurized container, said plug having a central platform with an opening going therethrough for receiving said continuous valve;

a measuring cap having a resilient diaphragm supported by a diaphragm support, said diaphragm support having a central foot, an axial passage passing through said central foot, a connecting sleeve having a first engaging rib extending from said diaphragm support, a coupling connecting said diaphragm support with said plug, said coupling having a dispensing port in a central chamber extending in the direction of the diaphragm support, said central chamber having a second engaging rib, whereby in an assembled condition of the dispensing head said first engaging rib of the connecting sleeve engages said second engaging rib of the central chamber in a locking manner to keep the assembly together, said central chamber and said connecting sleeve having a substantially cylindrical configuration.

6. A dispensing head for a pressurized container using a continuous valve, comprising a plug adapted for sealing engagement with the pressurized container, said plug having a central platform with an opening going therethrough for receiving said continuous valve;

a measuring cap having a resilient diaphragm supported by a disphragm support, said diaphragm support having a central foot, an axial passage passing through said central foot, a connecting sleeve having a first engaging rib extending from said diaphragm support.

a coupling connecting said diaphragm support with said plug, said coupling having a dispensing port in a central chamber extending in the direction of the diaphragm support, said central chamber having a second engaging rib, whereby in an assembled condition of the dispensing head said first engaging rib of the connecting sleeve engages said second engaging rib of the central chamber in a locking manner to keep the assembly together, at least one resilient supporting element extending outwardly from the diaphragm support in the direction of the coupling, said resilient supporting element having one end being permanently attached to the diaphragm support and a second free end, whereby in the assembled condition of the dispensing head said free end of the supporting element engages the coupling, and the spring-type action of the supporting element ensures working engagement between the first and second engaging ribs and also ensures positioning of the measuring cap substantially upwardly.

7. A dispensing head for a pressurized container having a continuous valve, comprising a plug adopted for sealing engagement with the pressurized container, said plug having a central platform with an opening going therethrough for receiving of said continuous valve;

a measuring cap having a resilient diaphragm supported by a diaphragm support, said diaphragm support having a central foot with a free end, an axial passage passing through said central foot, a receiving element positioned at said free end of the central foot, a coupling connecting said diaphragm support with said plug, said coupling having a disk defined by at least inner and outer surfaces, an axial passage passing through the disk, an engaging member extends outwardly from said outer surface and surrounds said axial passage, said receiving element of the central foot being adopted to receive said engaging member; and a supporting member extending from the inner surface and surrounding said axial passage, said supporting member being adopted for cooperation with the continuous valve of the pressurized container.

* * * * *